US005817213A

United States Patent [19]

Ostermayer et al.

[11] Patent Number: 5,817,213

[45] Date of Patent: Oct. 6, 1998

[54] PAPER PRODUCT FORMED FROM EMBOSSING FABRIC

[75] Inventors: Volker Ostermayer, Greenville; Scott Quigley, Simpsonville, both of S.C.

[73] Assignee: Wangner Systems Corporation, Greenville, S.C.

[21] Appl. No.: 608,770

[22] Filed: Feb. 29, 1996

Related U.S. Application Data

[63] Continuation-in-part of Ser. No. 387,436, Feb. 13, 1995, Pat. No. 5,542,455.

[51] Int. Cl.[6] ..... D21H 27/02

[52] U.S. Cl. ..... 162/109; 162/111; 162/113; 162/116; 162/117

[58] Field of Search ..... 162/109, 111, 162/112, 113, 116, 117

[56] References Cited

U.S. PATENT DOCUMENTS

| | | | |
|---|---|---|---|
| 3,974,025 | 8/1976 | Ayers | 162/113 |
| 4,191,609 | 3/1980 | Trokhan | 162/113 |
| 4,239,065 | 12/1980 | Trokhan | 139/383 |
| 4,507,173 | 3/1985 | Klowak et al. | 162/113 |
| 5,277,761 | 1/1994 | Phan et al. | 162/109 |
| 5,328,565 | 7/1994 | Rasch et al. | 162/109 |

*Primary Examiner*—Peter Chin

*Attorney, Agent, or Firm*—Henry S. Jaudon; Cort Flint

[57] ABSTRACT

A wet-laid paper having an outer surface configured to be pleasing to the eye and further having improved bulk, softness, and width wise stretch ratio without loss of tensile strength. The paper is characterized spaced diagonally arranged continuous zones or rows of compressed fibers extending across the width of the paper. These compressed zones or rows are separated with diagonally arranged arrays of uncompressed pillow like zones of uncompressed fibers which are at least partially encircled with picket like lineaments of compressed fibers. The invention includes the process of making the paper.

1 Claim, 3 Drawing Sheets

PAPER PRODUCT FORMED FROM EMBOSSING FABRIC

This application is a continuation-in-part of application Ser. No. 08/387,436 filed on Feb. 2, 1995 now U.S Pat. No. 5,542,455.

BACKGROUND OF THE INVENTION

This invention relates to a soft absorbent, wet-laid imprinted creped paper which is characterized by diagonally arranged uninterrupted rows of compressed fibers which are interposed between spaced diagonal arrays of juxtaposed pillows of uncompressed fibers. Troughs or lineaments of compressed fibers are arranged diagonally of the paper to define at least portions of the individual pillows.

Creped paper which presents a textured surface which is pleasing to the eye and yet possesses a soft feel, a high absorbency capacity, good strength and good stretch characteristics, has long been recognized as a product in demand. Numerous attempts have been made to produce such a product and some of these efforts have met with varying degrees of success.

One of the first relatively successful efforts at producing a creped paper having a significant number of the above qualities is disclosed in U.S. Pat. No. 3,301,747 to Sanford et al. The creped paper disclosed in the patent is characterized by transverse crepe folds which are substantially uninterrupted. Sanford et al discloses the use of imprinting fabrics woven in a square weave, a twill weave or a semi-twill weave.

Another soft wet-laid creped paper is disclosed in U.S. Pat. No. 3,974,025 to Ayers. This paper, as disclosed by Ayers, is formed with spaced rows, comprised of diamond shaped patterns, which extend transversely of the paper. The patent discloses using the back side of a drying fabric woven in a twill or semi-twill weave.

Yet another wet-laid crepe paper is disclosed in U.S. Pat. No. 4,191,609 to Trokham. Here a creped paper is disclosed which is characterized by arrays of uncompressed zones extending diagonally of the fabric. Each transversely extending array is comprised of successively arranged pillows of uncompressed fibers which are encircled by lineaments formed of areas of compressed fibers which form zones which extend along parallel lines diagonally across and along the fabric. The patent discloses using imprinting fabrics woven in various twill and semi-twill weave patterns. An Atlas weave pattern is preferred. It is of particular relevance to note that the forming fabrics used in the production of paper in Trokham have been heat set to provide that certain of the warp and the weft present knuckles having top surfaces which lie along a common plane. Certain other of the warp is controlled to present knuckles which are sub-top surface and which lie along a sub-top surface pole.

The weave disclosed in co-pending U.S. application Ser. No. 08/387,430 is a ten pick, five warp repeating pattern woven in a modified Atlas weave in which weft yarn of a large diameter and weft yarn of a small diameter are interwoven in alternating manner with the warp yarns. The warp shedding sequence is 1, 3, 5, 2, 4; however, the sequence must be repeated before a complete weave pattern is produced because of the arrangement of the varying diameter weft yarns. The shedding sequence along with the weft yarn arrangement produces an imprinting surface in which certain warp and weft yarn crossovers present top surfaces along a first plane while other warp and weft yarn crossovers are along a second plane spaced below the first plane. The result of these variable plane crossovers for both the warp and weft yarns form continuous diagonal ridges along the length and across the width of the fabric which are separated by arrays of pockets also disposed diagonally along and across the fabric.

As compared with the above discussed prior art, the present invention in a first embodiment provides a soft, absorbent, flexible wet-laid sheet of paper which is characterized by alternating arrays of uncompressed fibers forming pillows separated by continuous rows or depressions of compressed fibers. Both the rows and pillows are arranged as staggered extensions both in the length and width direction of the paper. The pillows are at least partially defined by lineaments of compressed fibers while the rows are defined by uncompressed fibers forming portions of the extremities of the pillows.

When creped, the paper of each embodiment provides high bulk, a high stretch ratio in both the length and width dimensions and reduced flexural rigidity. The reduction in flexural rigidity is achieved by the reduced number of compressed fibers. The imprinted surface of the paper is also embossed with an appealing and recognizable pattern.

SUMMARY OF THE INVENTION

The above objectives are accomplished according to the present invention by the provision of a soft absorbent sheet of creped paper comprising a plurality of zones of uncompressed fibers extending diagonally along and across the surface thereof. A plurality of zones of compressed fibers are arranged intermediate adjacent pairs of the uncompressed zones to extend diagonally along and across the surface of the paper.

Each of the uncompressed zones comprise a plurality of pillow like areas formed of uncompressed fibers which are partially delineated by a plurality of lineaments of compressed fibers. Each of the compressed zones comprise a continuous row of compressed fibers delineated by only certain of the fibers forming pillows of uncompressed fibers.

The linear arrays of uncompressed fibers forming the pillow like areas are arranged in juxtaposed relationship along the length and across the paper sheet. The pillow like areas are arranged to appear over the surface of the paper at between about seven and one thousand five hundred per square inch.

The invention also includes the method of manufacturing a soft absorbent sheet of paper characterized by alternating uncompressed and compressed fiber zones arranged to extend transversely along and across the surface thereof. Each of the uncompressed fiber zones are formed to comprise a staggered array of closely spaced pillow like areas which are partially delineated with an array of lineaments formed of compressed fibers. Each of the zones of compressed fibers are formed as uninterrupted rows or depressions delineated by only outside or edge fibers of the uncompressed fibers forming arrays of spaced pillows. The method includes forming a paper web of uniform density throughout and of imprinting onto the paper web prior to its drying a network of lineaments comprising spaced areas of compressed fibers extending transversely and longitudinally of the paper sheet. The method also includes arranging the lineaments to partially circumscribe the uncompressed zones while at the same time providing that only certain of the uncompressed pillow forming fibers delineate the compressed zones. The method includes drying the paper web during the formation of the uncompressed and compressed zones to form the paper sheet. Also the creping of the dried paper sheet.

A soft absorbent paper sheet is formed of compressed and uncompressed fibers. The fibers are arranged to form a plurality of first fiber zones of uncompressed fibers which extend diagonally along and across the paper sheet and a plurality of second fiber zones of compressed fibers which also extend diagonally along and across the paper sheet. Each of the first zones comprise a plurality of pillows which are partially delineated by lineaments of compressed fibers. Each of the second zones comprise a continuous depression whose longitudinal extremities delineate the remainder of the pillows.

The lineaments of compressed fibers are arranged to extend along a line substantially transverse to the longitudinal direction of the paper sheet. The compressed fibers forming the lineaments vary in the degree of compression widthwise along their length.

A method of manufacturing a soft absorbent sheet of paper characterized by arranging first and second zones of uncompressed and compressed fibers to extend transversely along and across said sheet of paper in an alternating manner. Each first zone of uncompressed fibers comprises a staggered array of closely spaced pillow like areas with each pillow like area being partially circumscribed with an array of lineaments of compressed fibers. Each of the second zones of compressed fibers comprises an uninterrupted row or depression including outer borders forming fibers. These border fibers of the depressions or rows of compressed fibers act to delineate the remainder of the pillows.

The method comprises forming a paper web having substantially uniform density throughout; of imprinting a network of transversely extending lineaments of compressed fibers on the surface of the web prior to drying; of arranging the lineaments to partially circumscribe and form pillow like areas along the first zones; and of arranging the second zones so that their opposing boundaries delineate the remainder pillow like areas.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 6:
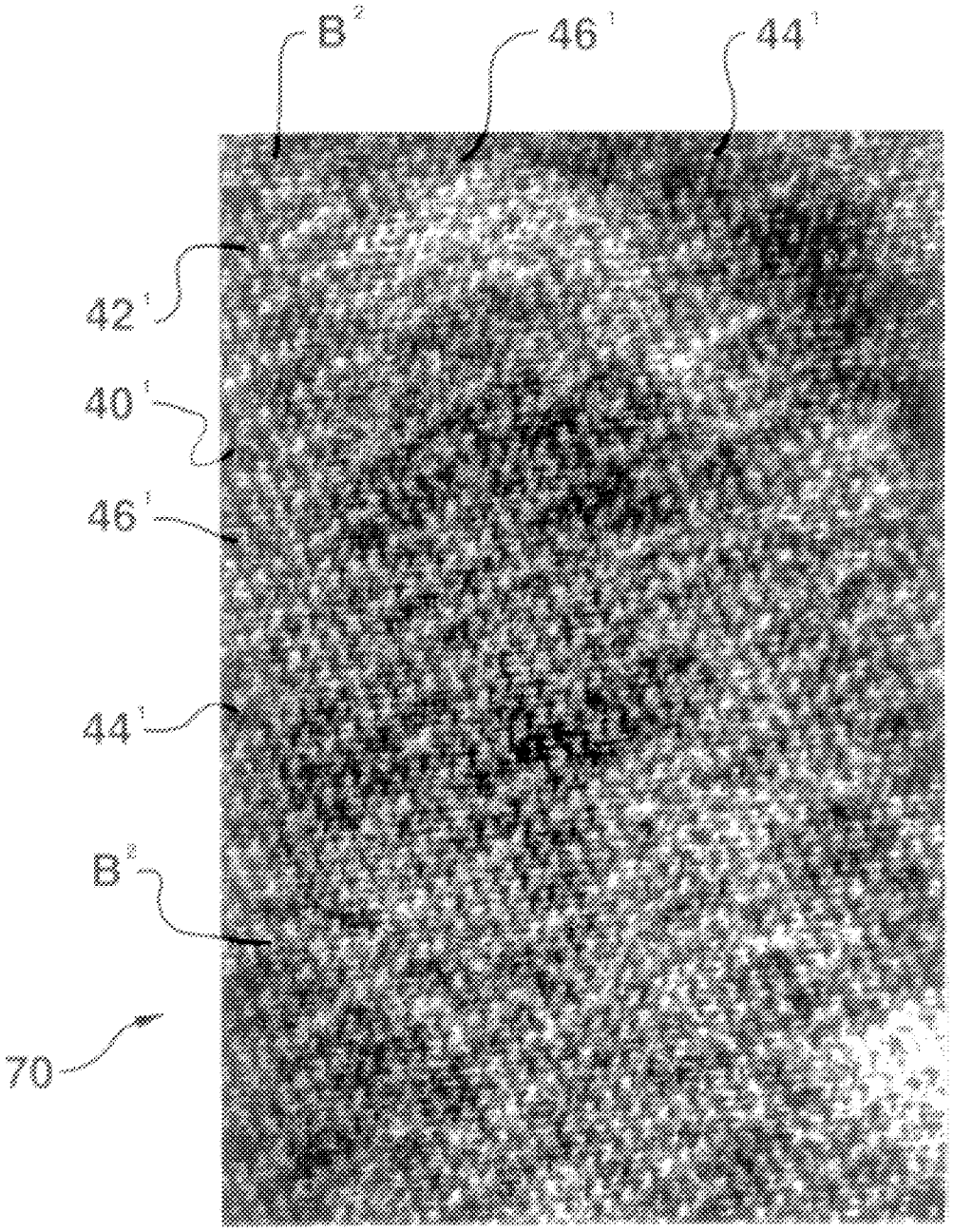
FIG. 6 is a top view of the sculptured paper product of the invention.

Referring now to FIG. 6 there is shown the fabric imprinted side of a piece of creped paper 70 of the invention. As is usual with creped paper, the surface contains successive transverse crepe marks or lines which are formed as the creping blade removes the paper from the dryer drum. The surface also possesses a textured appearance which is brought about when the outer configurations of the yarns forming the dryer fabric come in contact with the paper forming fibers during drying. These features are universally occurring in all paper dried with the Yankee dryer. Additionally, the paper sheet of the invention is characterized by alternating arrays comprising rows or depressions 44' formed of compressed fibers and arrays 40' comprising a series of side by side pillows $B^2$ of uncompressed fibers. The depressions 44' and arrays 40' are arranged in alternating fashion and extend diagonally along and across the paper sheet. FIG. 6 clearly illustrates the arrangement of the alternating arrays 40' and rows or depressions 44' as they traverse the paper sheet 70 creating the textured appearance of the paper surface as discussed above.

The longitudinally extending zones 46' arranged between adjacent pillows $B^2$ constitute lineaments of compressed fibers. Lineaments 46' assist in defining each of the pillows $B^2$, diagonally and in the direction of the paper sheet.

Figure 1:
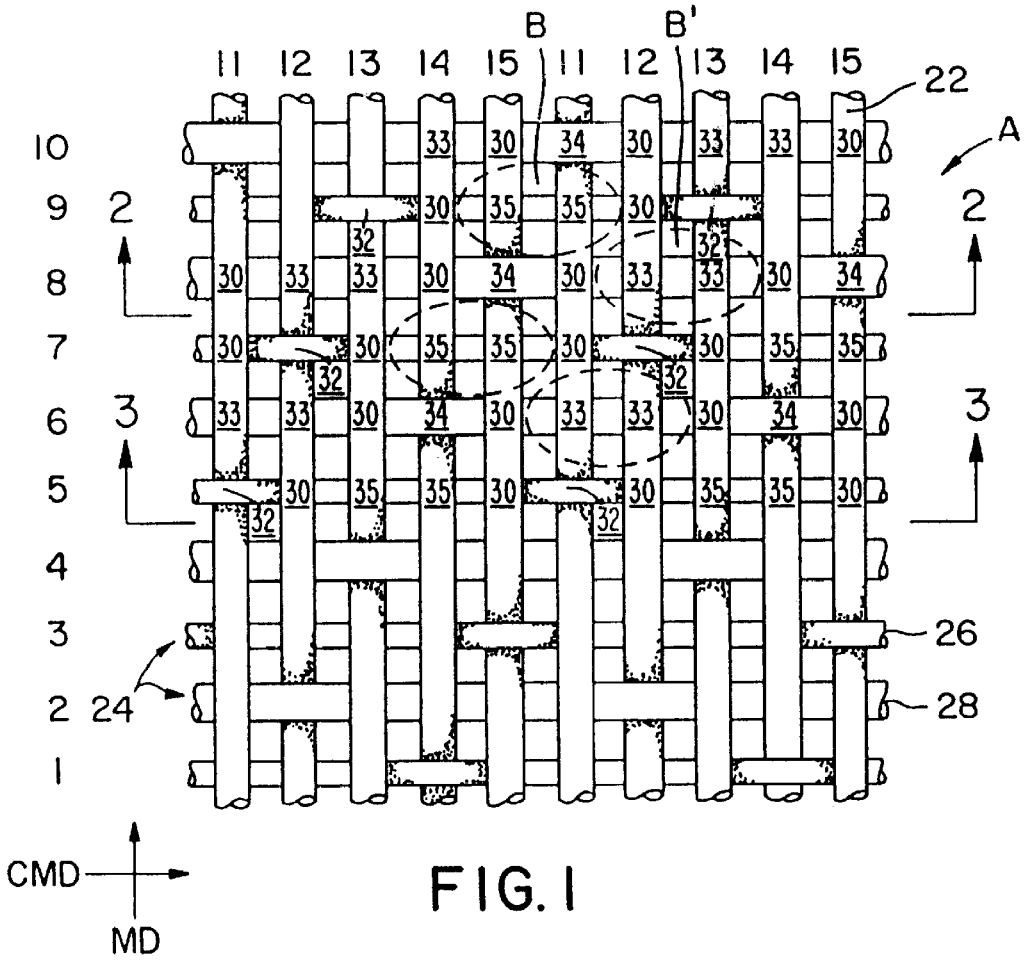
FIG. 1 is a top view of a weft repeat of the weave pattern of the fabric for producing the paper product of the invention which is shown as formed with alternately arranged large and small diameter weft yarns (CMD).

FIG. 1 is a sectional top view of the papermaking fabric which embosses the paper surface of the paper of the invention. The figure shows support surface A in a single repeat in the weft direction and two repeats in the warp direction of the weave pattern. The weave pattern is a modified Atlas which consist of ten weft yarns which generally extend in the cross machine direction (CMD) and five warp yarns which generally extend in the machine direction (MD) per pattern repeat. The warp yarns of the pattern repeat are numbered 11–15 and are identified with numeral 22 while the weft yarns are numbered 1–10 and are identified with the numeral 24.

Weft yarns 24 comprise small diameter yarns 26 and large diameter yarns 28. These yarns are arranged throughout the weave pattern and along the length of the fabric in alternating manner as shown in FIG. 1. Large diameter weft yarns 28 normally have a diameter of between 0.41 and 0.49 mm with the preferred size being 0.44 mm. Small diameter weft yarns 26 normally have a diameter of between 0.26 and 0.34 mm with the preferred size being 0.30 mm. Weft yarns 24 preferably are formed of synthetic monofilaments having a circular cross section. The weft yarns may also have shaped cross sections such as rectangular or oval and that all weft yarns may be of one or a plurality of cross sectional shapes. Alternatively shaped and circular cross sectional weft yarns could be utilized in an arranged sequence. The preferred synthetic materials forming the weft yarns are of polyamide, polyester, polyaryletherketones or a blend of any of the above.

Warp yarns 22 are preferable formed of synthetic monofilaments of a circular uniform diameter which normally ranges from between 0.30 and 0.38 mm. The preferred diameter is 0.34 mm. While it is preferred that the warp yarns are formed of monofilaments of circular cross section it is contemplated that shaped monofilaments as described above could be used. The warp yarns are preferably formed of the same synthetic materials as indicated for the weft yarns.

Again referring to FIG. 1, it can be seen that weft yarns 1 and 6 weave under warp yarns 11–13, over warp yarn 14 and under warp yarn 15. Weft yarns 2 and 7 weave under warp yarn 11, over warp yarn 12 and under warp yarns 13–15. Weft yarns 3 and 8 weave under warp yarns 11–14 and over warp yarn 15. Weft yarns 4 and 9 weave under warp yarns 11 and 12, over warp yarn 13 and under warp yarns 14–15. Weft yarns 5 and 10 weave over warp yarn 11 and under warp yarns 12–15. While the warp, weft relationship between weft yarns 1, 6; 2, 7; 3, 8; 4, 9; and 5, 10 is identical the resulting surface configuration differs through the ten pick repeat because the odd numbered weft yarns identified with numeral 26 are smaller in diameter than the even numbered weft yarns identified with number 28. As a result, it requires ten weft yarns and five warp yarns to produce a complete pattern repeat.

Figure 2:
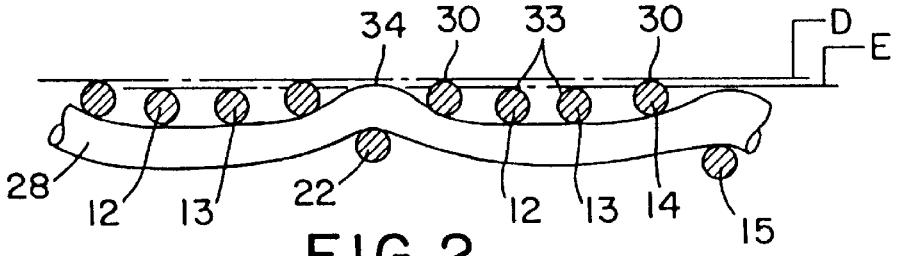
FIG. 2 is a section view taken along line 2—2 of FIG. 1 showing the relationship of the warp yarns (MD) and the large diameter CMD yarn.

Turning now to FIG. 2, taken along line 2—2 of FIG. 1, it can be seen that as weft yarn 8 of the large diameter weft yarns 28 traverses the smaller diameter warp yarns 22 there is a minimum amount of crimp produced in the weft yarn. By varying the size ratio between the weft yarns 28 and warp yarns 22, the degree of crimp placed in the large weft yarns can be controlled. The preferred diameter of 0.44 mm for weft yarns 28 interweaving with warp yarns of 0.30 mm diameter provides a minimal crimp which leaves the upper or crossover surfaces 34 of weft yarns 28 lying along a lower or sub-support surface substantially horizontal plane E. Also, it can be seen that the upper surfaces of crossovers 33 of warp yarns 12 and 13 where they cross over weft 28, also are positioned to lie along the sub-support surface or lower substantially horizontal plane E. The upper surfaces or support surface crossover 30 of warp yarns 11 and 14 are elevated to extend along a common upper or support surface substantially horizontal plane D where they cross over weft yarns 28. These crossover positions are brought about primarily because of the high resistance to bending possessed by the large diameter weft yarns 28 when pressed by the smaller diameter warp yarns 22.

Figure 3:
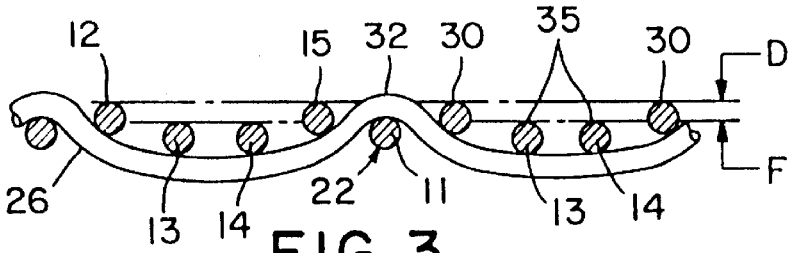
FIG. 3 is a sectional view taken along line 3—3 of FIG. 1 showing the relationship of the warp yarns (MD) and the small diameter CMD yarn.

Turning now to FIG. 3, which is taken along line 3—3 of FIG. 1, the configuration of weft yarn 5 of smaller weft yarns 26 can be seen as it traverses through warp yarns 22. Here the upper surfaces or crossover surfaces 30 of warp yarns 11 and 15 can be seen as extending along the common upper or support surface plane D as they cross over weft yarn 3 of weft yarns 26 while the upper surfaces or crossover surfaces 35 of warp yarns 13 and 14 where they cross over weft yarn 26 are aligned along a second sub-support surface plane F which lies below the sub support surface plane E of the sub support surface crossovers 33. The positioning of crossovers 30 and 35 is controlled by weft yarns 26, which are of a diameter smaller than that of both weft yarn 28 and warp yarn 22. Because of this smaller diameter, these yarns have a low resistance to bending and are crimped by the larger diameter warp yarn as they cross thereover so that their upper surfaces at crossover 32 with warp yarn 11 of warp yarns 22 are raised or brought up to lie also along upper plane D and aligned with the crossover surfaces 30 of warp yarns 12 and 15. The support surfaces of crossovers 35 of warp yarns 12, 13 as they pass over weft yarn 3 of weft yarns 26 are aligned with a second sub-support surface plane F which plane is lower than sub-support surface plane E. Again, the larger warp yarns 22 force the smaller weft yarn 26 downward as they tend to maintain their position.

Returning to FIG. 1, it can be seen that support surface crossovers 30 of warp yarns 22 along with sub-support surface crossovers 34 of weft yarns 28 form picket defining lineaments around sub-support surface crossovers 35, of warp yarns 22 defining a series of pockets B. The series of pockets B are arranged in spaced diagonal rows along the length of the fabric. Also, support surface crossovers 30 along with support surface crossovers 32 of weft yarns 26 form lineaments about sub-support surface crossovers 33 defining pockets B'. These pockets are formed along diagonal lines arranged in alternating fashion with the diagonal lines along which pockets B are formed.

Support surface A as shown in FIG. 1 provides a contact area of about 26% for supporting the paper forming fibers during drying. It has been found that an improved product can be produced by increasing the contact area to somewhere in the range of 43%. This larger contact area provides for increased heat transfer between the drying drum and the paper forming fibers and also provides for better adhesion of the fibers with the dryer drum during drying.

In order to transform support surface A of the fabric shown in FIG. 1 to satisfy these requirements the support surface is subjected to sanding or grinding.

Figure 4:
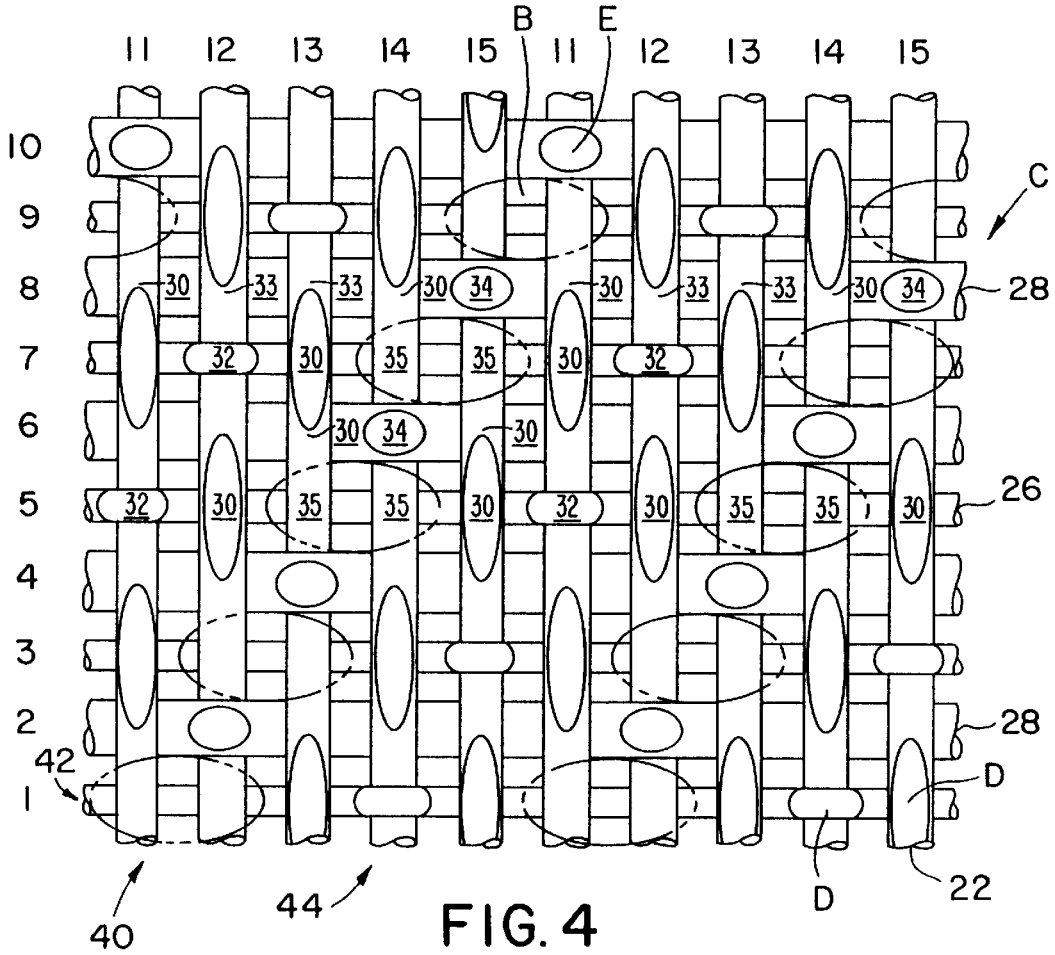
FIG. 4 is a top view of the fabric similar to FIG. 1 with the support surface sanded.

Crossovers 30 of warp yarns 22 along with crossovers 32 of weft yarns 26 are sanded down approximately 0.2 mm lowering their support surfaces to be substantially aligned with sub-support surface plane E. The sanding produces flat or planar support surface areas D. Crossovers 34 of weft yarns 28 may also be sanded to produce flat or planar support surface areas E, however, sanding here is to a lesser degree and in some instances is not necessary. By providing flat support surface areas D, E the area of contact is increased approximately 17% bringing the contact area for support surface C to around 43%. Crossovers 35 which extend along the second sub-support surface plane F remain below the plane of sanding and below the support surface now formed along plane E to form lower surfaces of pockets B. As shown in FIG. 4, lineaments formed by sanded crossovers 30, 34 which define pockets B along diagonal lines or rows 40 along the length of the fabric and also along lines or rows 42 which extend transversely of the fabric.

Strips 44 which are defined by crossovers 30, 32 and 33 are arranged intermediate diagonal rows 40 of pockets B and present a support surface which is substantially monoplanar. Strips 44 provide increased support surface area to better control the paper forming fibers during drying and also provide for increased heat transfer which promotes more complete and uniform drying.

It can be seen in FIG. 4 that each of crossovers 30 and 33 after sanding also extend along plane E. However, those portions of the upper surface of these crossovers where they begin to pass under a weft yarn 24 drop into a plane below plane E. Likewise weft yarns 24 at crossovers 32 and 34 after sanding also extend along plane E. These crossovers also drop below plane E where these yarns begin to pass under a warp yarn 22. These small areas are designated sub-surface areas 36 and they constitute between 5 and 15% of support surface area arranged below plane E.

Similarly, where crossovers 35 of the warp yarns forming lower plane F begin to pass over an adjacent weft yarn the support surface of the yarn becomes elevated slightly above the sub support surface plane F. These above sub-support areas are designated 37.

Figure 5:
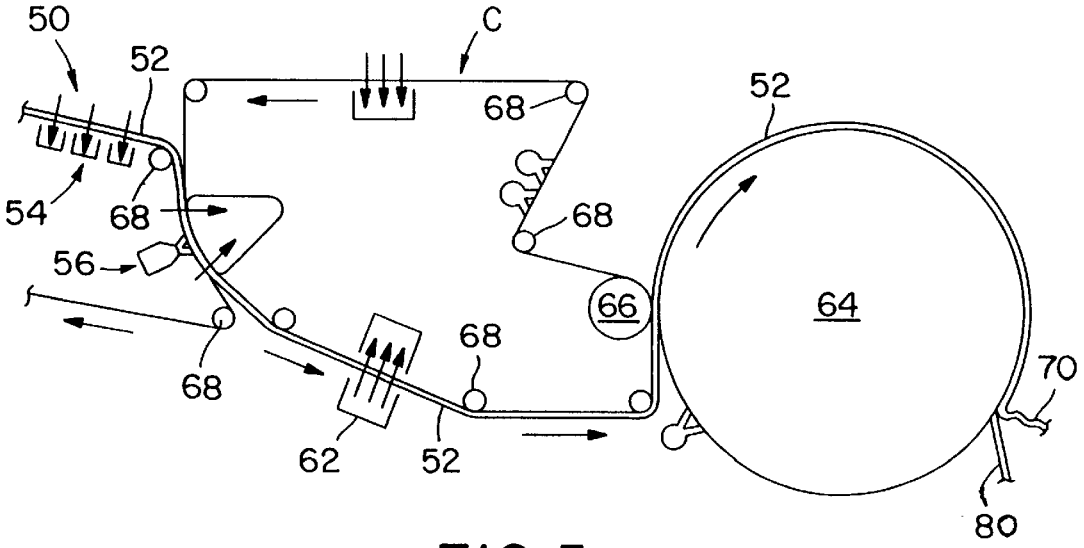
FIG. 5 is a schematic side view of a thorough air drying system used to form the paper product of the invention.

Turning now to FIG. 5, there is shown a sectional schematic view of a papermaking machine utilizing drying and embossing fabric 50 for the manufacture of paper such as paper 70 of the invention. The arrangement shown includes forming fabric C which carries the paper forming fibers 52 past de-watering vacuum boxes 54 to the transferring device 56. Transfer device 56 includes an air jet and a vacuum box. Here the paper forming fibers 52 are transferred onto the support surface C of the drying and embossing fabric which rotates about idler rolls 68. The forming fibers are moved first through pre-dryer 62. After passing pre-dryer 62, support or embossing surface C of the drying embossing fabric carries the paper forming fibers 52 between pressure roll 66 and Yankee dryer drum 64.

Embossing surface C compresses paper forming fibers 52 in a substantially uniform manner along rows 40 and also width wise the paper along wefts 28 at crossovers 34. A slight variation in compression of the fibers occurs along the edges of each of the compressed areas defining lineaments 46' and rows 44' where the crossover portions 36 engage with paper forming fibers 52. In these areas, the fibers are less compressed in a range of between 3 and 10%.

There is a similar variation in the compression of fibers 52 in the compressed fibers forming pillows B". In this instance, the edge fibers contacted by crossover areas 37 are slightly more compressed than the remaining fibers forming the pillows.

The papermaking machine includes idler pulleys 68 which circulate forming fabric 50 and drying and embossing fabric surface C, through the machine. Also the usual cleaning showers and de-watering box are shown. This apparatus and its functions are well known and are disclosed in U.S. Pat. No. 3,301,746.

As pressure roll 66 presses the drying and embossing surface C carrying the paper forming fibers 52 against Yankee drum 64 embossing surface C embosses the outer surface of the paper texturing its surface area by compressing only certain of the paper forming fibers to create the areas of compressed and uncompressed fibers as earlier discussed. As drum 64 carries paper forming fibers 52 toward creping or doctor blade 80 the final drying is carried out. Doctor blade 80 removes paper sheet 70 at a rate to allow a residual crimp or crepe of about 30%. Crepe lines which extend transversely of the paper sheet are usual with this drying apparatus.

Paper 70 preferably has a basic weight range of from 15 to 20 lbs per 3000 square feet, a % CD stretch of between 8.3 and 10.7, and a % MD stretch of between 40 and 43. Its flexural rigidity is improved and its absorption capacity is increased.

While preferred embodiments of the invention has been described using specific terms, such description is for illustrative purposes only, and it is to be understood that changes and variations may be made without departing from the spirit or scope of the following claims.

What is claimed is:

1. A method of forming a soft absorbent sheet of paper characterized by alternating zones of uncompressed and compressed fibers arranged to extend diagonally of and across said sheet of paper, each said zone of uncompressed fibers comprising an array of closely spaced pillow-like areas in which each pillow like area is circumscribed with rows and lineaments forming said zones of compressed fibers, said method comprising;

forming a paper web on a support surface of a paper forming fabric having diagonal rows of depressed pockets arranged in spaced fashion along the length and diagonally of said fabric, said rows of pockets being separated and defined by diagonal strips formed by a set of MD yarn crossovers and a first set of CMD yarn crossovers and transverse strips formed by a second set of CMD yarn crossovers and said set of MD yarn crossovers, said MD and CMD yarn crossovers lying along a common plane;

forming said lineaments as successive, uninterrupted longitudinally spaced depressions to extend perpendicularly across said web by compressing those fibers of said paper web supported by said transverse strips;

forming said rows as successive, uninterrupted, transversely spaced depressions which extend diagonally along said web by compressing those fibers of said paper web supported by said diagonal strips;

forming said pillow-like areas from fibers of said web which are arranged over said pockets, said pillow-like areas being circumscribed by said lineaments and rows of compressed fibers; and drying said paper web as a paper sheet.

* * * * *